United States Patent [19]

Clark

[11] 4,184,819

[45] Jan. 22, 1980

[54] SECONDARY SPEED SENSOR FOR GOVERNED AIR GRINDERS

[75] Inventor: Melvin D. Clark, West Unity, Ohio

[73] Assignee: The Aro Corporation, Bryan, Ohio

[21] Appl. No.: 871,389

[22] Filed: Jan. 23, 1978

[51] Int. Cl.[2] ..... F01C 21/12; G05D 13/10

[52] U.S. Cl. ..... 418/43; 137/57; 73/538

[58] Field of Search ..... 418/40–44; 137/57; 73/538; 200/61.39, 61.46, 80 R

[56] References Cited

U.S. PATENT DOCUMENTS

| | | | |
|---|---|---|---|
| 860,124 | 7/1907 | Bliss | 200/80 R |
| 3,279,485 | 10/1966 | Alexander | 418/43 |
| 3,519,372 | 7/1970 | Peale | 418/43 |
| 3,767,332 | 10/1973 | Wickham et al. | 418/43 |

FOREIGN PATENT DOCUMENTS

| | | | |
|---|---|---|---|
| 283294 | 1/1928 | United Kingdom | 137/57 |

*Primary Examiner*—John J. Vrablik

*Attorney, Agent, or Firm*—Allegretti, Newitt, Witcoff & McAndrews

[57] ABSTRACT

A speed sensor is attached to the output shaft of the rotary vane air motor. The speed sensor includes a body member which is pivotally mounted at one end on the output shaft for movement about an axis parallel to the shaft axis. The opposite end of the body member is biased into engagement with a locking pin. So long as the shaft of the air motor does not exceed a threshold speed, the body member remains in the described position. Upon exceeding a threshold speed, the body member disengages from the locking pin due to centrifugal force acting thereon and then engages a movable shutter. In this manner, the shutter is moved by the body member to close air flow passages to the air motor.

7 Claims, 3 Drawing Figures

SECONDARY SPEED SENSOR FOR GOVERNED AIR GRINDERS

BACKGROUND OF THE INVENTION

This invention relates to a speed sensor device and more particularly to a speed sensor which may be incorporated with an air motor to detect a threshold speed of the output shaft of a rotary vane air motor and effect cutoff of air to the motor in the event the speed of the motor becomes excessive.

The use of governors for speed control of rotary vane air motors is well known. Governor or speed control mechanisms are utilized in combination with air motor tool devices to control air flow to the motor and thus the speed of the motor. Additionally, speed sensor devices associated with the rotary shaft of an air motor are utilized to terminate air flow to air motors in the event that excessive speeds occur due to some failure in the motor.

Patents disclosing various methods for providing overspeed control for rotary vane air motors include U.S. Pat. No. 3,767,332. That patent discloses positioning of weights on opposite sides of a rotating output shaft of an air motor. At rotational speeds below a preselected level, the weights remain positioned tightly against the shaft. When the rotational speed of the shaft exceeds a preselected level, the weights are driven radially outwardly due to centrifugal force. As the weights swing outwardly, they engage a trigger mechanism which, in turn, operates a mechanical linkage to terminate the supply of air to the air motor. U.S. Pat. No. 2,586,968 discloses a similar fly weight mechanism as does U.S. Pat. No. 3,519,372.

U.S. Pat. No. 3,749,530 discloses yet another approach utilizing the centrifugal force associated with the rotating shaft of an air motor. In U.S. Pat. No. 3,749,530, a Bellville spring is responsive to the deflective forces imparted by centrifugal force thereon to bend or deflect the spring to a position which will close air inlet passages in the event of excessive speed of the output shaft of the air motor. U.S. Pat. No. 2,973,771 and U.S. Pat. No. 1,384,113 show similar devices.

While the referenced patents disclose speed sensor and speed control devices which are adequate for their purposes, a device of simpler construction with fewer parts has been sought. Such a device would be less expensive to manufacture, easier to service and more sensitive to various speeds of a rotary output shaft.

SUMMARY OF THE INVENTION

Briefly, the present invention of a speed sensor for a rotating shaft includes a body member which is pivotally mounted on the shaft about an axis which is generally parallel to the shaft axis. The body member is mounted so that it may both pivot and move in a transverse direction relative to the shaft axis. The body member is normally held in engagement with a locking pin on the shaft by biasing means. Rotation of the shaft beyond a threshold speed causes the centrifugal forces acting on the body member to overcome the biasing forces acting on the body member. This causes release of the body member from engagement with the locking pin. The body member may then pivot into engagement with a shutter mechanism to move the shutter mechanism and terminate air flow for driving the air motor.

It is thus an object of the present invention to provide an improved speed sensor device.

It is a further object of the present invention to provide improved speed sensor device particularly useful in combination with rotary vane air motors.

Another object of the present invention is to provide a speed sensor device constructed to detect the threshold speed of a rotary shaft and provide a mechanical output in response to that threshold speed.

Still another object of the present invention is to provide an overspeed control sensor for use in a rotary vane air motor tool.

Another object of the present invention is to provide an improved speed sensor device which is easily adjustable.

Another object of the present invention is to provide a speed sensor device of simple and economic construction which may be easily incorporated with existing rotary vane air motor tools.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
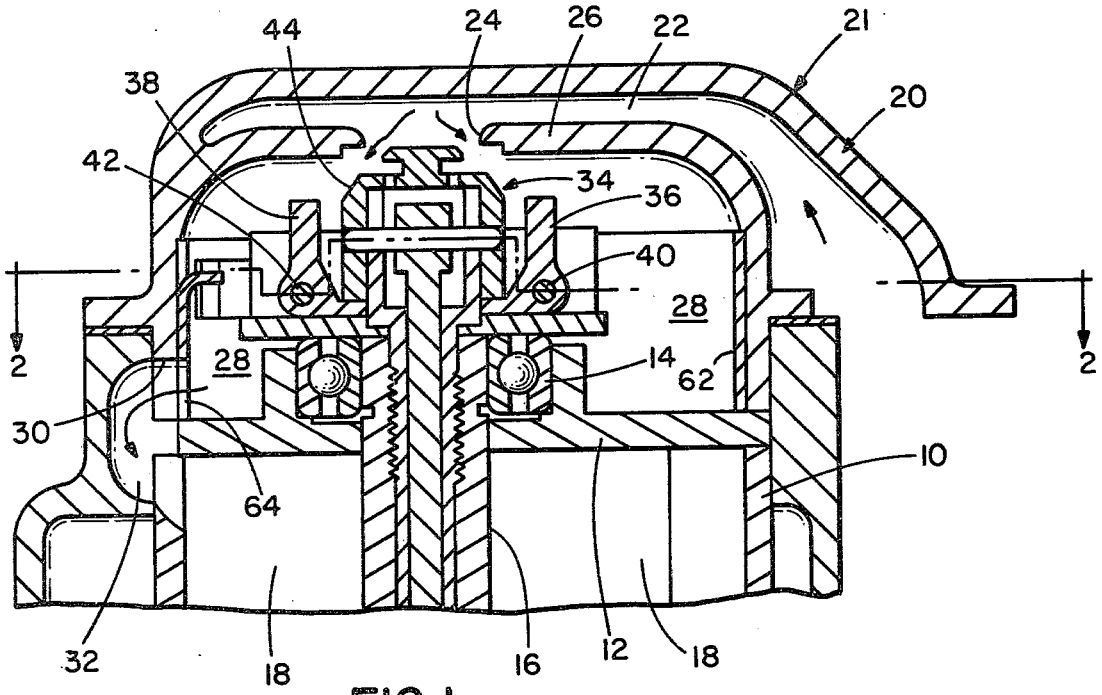
FIG. 1 is a partial cross-sectional view of a typical vane type air motor for an air tool including the improved speed sensor of the invention.

Referring to the figures and in particular FIG. 1, there is illustrated a typical rotary vane air motor retained within a housing 10. The housing 10 is generally cylindrical and includes spaced, opposed end plates. An end plate 12 has a bearing 14 for mounting a rotary shaft 16. The shaft 16 is eccentric with respect to the center line axis of the housing 10. Vanes or blades 18 are mounted on the shaft 16 for cooperation with the housing 10 in a manner known to those skilled in the art of rotary vane air motors.

The housing 10 includes a manifold 20 which directs inlet air through a channel 22 and into a port 24 defined in the interior wall 26 of manifold 20. Air passes through the port 24 under pressure into the chamber 28 surrounding the bearing assembly 14. Inlet air then flows from the chamber 28 through a port 64 in shutter 62 and connects with port 30 and channel 32 to the air motor so as to drive the vanes 18. In this manner, pressurized air is provided to drive the vanes 18 and thus the shaft 16 about its axis.

A governor, generally shown at 34, controls the size of the orifice through port 24. That is, centrifugal force acts upon flyweight members 36 and 38 which are pivotally mounted on pins 40 and 42 respectively. The inner end of each flyweight member 36 and 38 engages an orifice control member 44. As the shaft 16 rotates at increasingly higher speeds, the flyweights 36 and 38 tend to move respectively clockwise and counterclockwise as viewed in FIG. 1 due to increasing centrifugal force. The member 44 is thus positioned within orifice 24 to control the cross-sectional area and the volume of air flow to the motor. This ensures substantially constant motor speed and rotary speed of the shaft 16. The structure so far described is known in the prior art and is commonly used in many rotary vane air motors.

Figure 2:
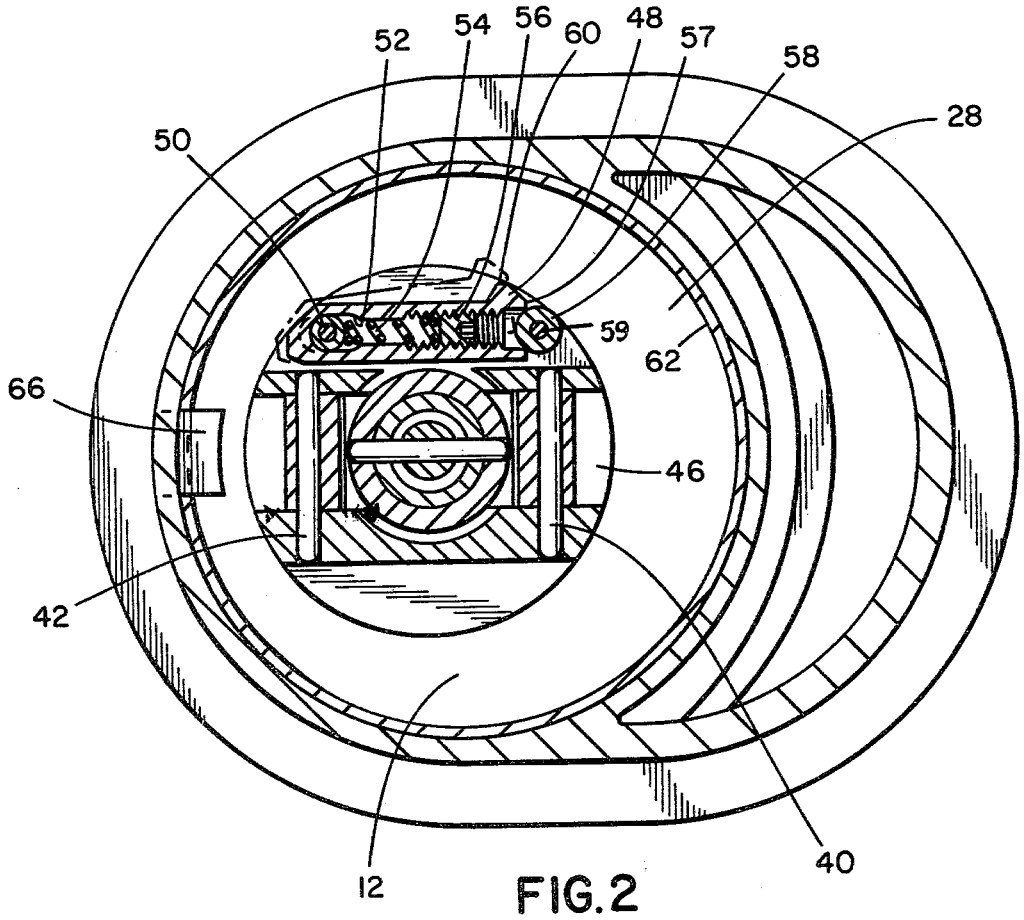
FIG. 2 is a cross-sectional view of the motor of FIG. 1 taken substantially along the line 2—2 with the speed sensor in the unreleased position.
Figure 3:
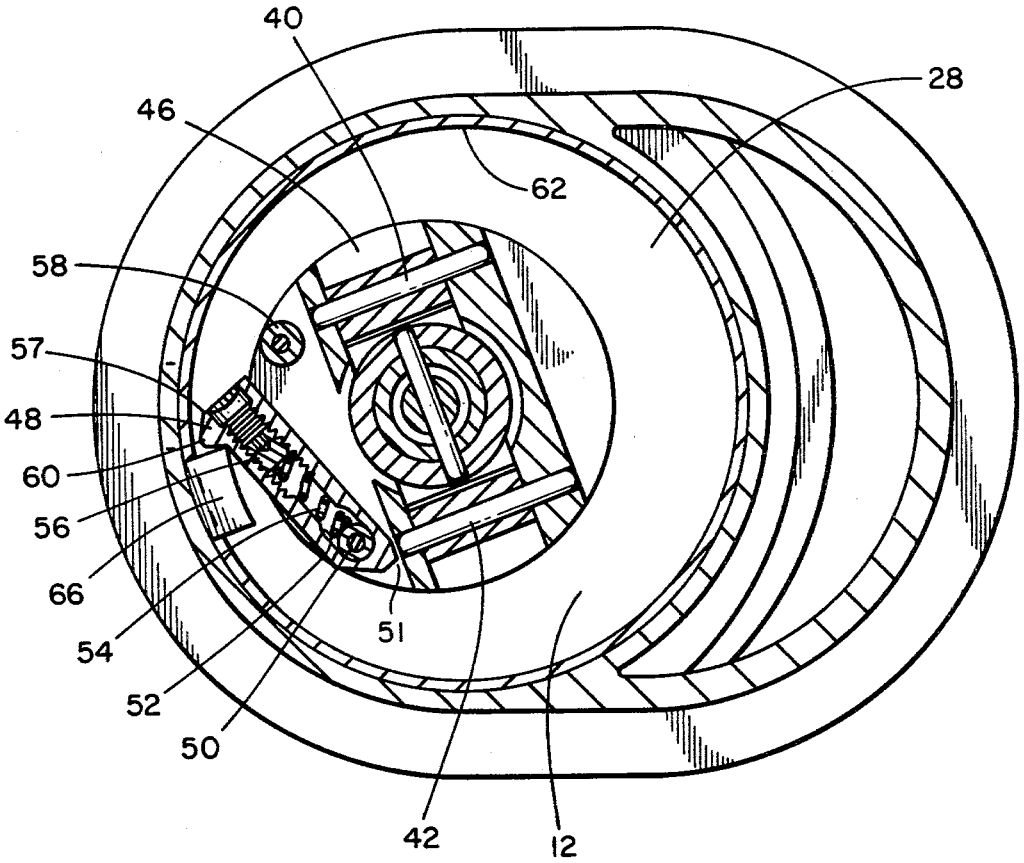
FIG. 3 is a cross-sectional view of the motor substantially the same as FIG. 2 wherein the speed sensor is in the released position.

The improvement of the present invention relates to the secondary or additional mechanism or structure which responds to a threshold speed of the shaft 16 and operates to terminate air flow through the port 30 thus stopping the air motor, particularly when that motor is in a "run-away condition." This structure is most clearly shown in FIGS. 2 and 3.

Referring to FIGS. 2 and 3, the shaft 16 includes a disc 46 which is affixed thereto and rotates coincidentally with shaft 16. The disc 46 is circular and is mounted concentrically with respect to the rotation axis of the shaft 16. A body member 48 is pivotally mounted on the disc 46 with the pivot axis of the body member 48 being spaced a fixed radial distance from the center of the shaft 16 and, in particular, being coincident with the pivot axis of a mounting pin 50 which is attached to the disc 46. The body member 48 includes a channel or slot 52 extending generally transverse along the body member 48. The pin 50 engages one end of the slot 52 and is retained at that one end by means of a spring 54 held in position by a set screw 56. The spring constant of the spring 54 as well as the position of the threaded set screw 56 within threaded channel 52 determines the force with which the body member 48 is retained in position.

The end 57 of the body member 48 opposite the pin 50 is recessed and cooperatively engages a second roller 58 on pin 59 attached to the disc 46. The spring 54 thus in effect biases the body member 48 against the roller 58 and normally retains the body member 48 in the position shown in FIG. 2 when the shaft 16 and fixed disc 46 are rotated. A needle bearing is used on the lock pin 59 to reduce the friction during disengagement and produce a more consistent trip speed.

The body member 48 includes an outwardly extending projection 60. Projection 60 extends radially outward from the center of disc 46.

A shutter member 62 is positioned within the manifold 20. The shutter member 62 is cylindrical and fits snugly against the interior wall of the housing 20. The shutter member 62 is normally positioned as shown in FIG. 1 and includes a window or slot 64 which permits passage of pressurized air through port 30 to drive the rotary vanes 18 of the air motor. The shutter member 62 is slidably mounted within the manifold 20 on the plate 12 and may be rotated relative to the walls of the manifold 20 to close port 30. A radially inward projecting tab 66 is defined on the shutter 62.

In normal operation, as previously recited, the body member 48 is retained in the position illustrated in FIG. 2. Upon reaching a threshold speed of rotation of shaft 16, the body member 48 translates against the force of spring 54 due to centrifugal force. The amount of translation of body member 48 is limited by slot 52 which receives pin 50. Such translation causes the body member 48 to disengage from pin 58. The body member 48 pivots about pin 50 so that the projection 60 of body member 48 engages the tab 66 of the shutter member 62. This engagement is illustrated in FIG. 3. The body member 48 then drags the shutter member 62 partially circumferentially about the interior of the manifold 20 thereby closing the port 30 and stopping the operation of the air motor. Because the shaft 16 is mounted eccentrically with respect to the manifold 20, the body member 48 disengages from the tab 66 upon closing of the port 30.

That is, pivotal motion of member 48 on shaft 50 is limited by the end 51 of member 48 in FIG. 3. Since the shaft 16 is positioned eccentrically with respect to the housing, member 48 will initially engage the shutter tab 66 and thereby translate the shutter 62 until member 48 releases from tab 66. Air flow to the air motor is then blocked or interrupted by shutter 62. The shaft 16 may continue to rotate though the shutter 62 and more particularly the tab 66 will be moved to a position where it may no longer make contact with member 48. Thus the shutter 62 remains in the air blocking position until it is reset.

To reset the body member 48, one must remove the manifold 20 from the housing 10. Then, the member 48 can be reset. Simultaneously, the device can be inspected to determine the reason for overrun speed and repaired.

While there has been set forth a preferred embodiment of the present invention, it is to be understood that the invention is to be limited only by the following claims and their equivalents.

What is claimed is:

1. An improved speed sensor device for attachment to a rotary shaft for sensing a threshold speed of the shaft, said shaft having a shaft axis of rotation, said sensor comprising, in combination:

a sensor body member attached to the shaft and pivotal about a mounting, said mounting having an axis generally parallel to and spaced from the shaft axis of rotation, said body member also being translatable in a direction generally transverse to the mounting axis between a locked position and an unlocked position, the weight of the body member being eccentric relative to the shaft axis;

locking pin means attached to the shaft for engaging the sensor body member in the locked position to hold the body member and prevent pivotal movement thereof about the mounting; and biasing means engaging the sensor body member to bias the body member toward the locked position with the locking pin means, the body member being translated against the force of the biasing means upon rotation of the shaft beyond the threshold speed to impart a centrifugal force to the body member and thereby cause release of the body member from engagement with the locking pin means and permit pivotal movement of the body member about the mounting axis.

2. The sensor of claim 1 wherein said biasing means is adjustable to provide a predetermined force for retaining the sensor body member in the locked position with the locking pin means.

3. The improved sensor device of claim 1 in combination with a rotary vane air motor of the type having an air inlet and an air exhaust and movable shutter means for closing air flow through the motor, and wherein said sensor body member is attached to the output shaft of the rotary vane air motor, said body member including means to engage the shutter means and operate the shutter means to terminate air flow through the air motor in response to movement of the sensor body member from the locked position.

4. The improved speed sensor device of claim 1 wherein said body member comprises a member including an elongated slot, said mounting comprises a pivot pin said slot being cooperative with the pivot pin for translation of the body member, and said biasing means comprises a spring within the slot extending between the pivot pin and one end of the slot.

5. The improved sensor of claim 1 wherein said sensor is mounted on a disc member affixed to the shaft, said mounting comprising a first pin affixed to the disc member and said locking pin means comprising a second pin affixed to the disc, said biasing means comprising a spring in a slot of the body member, said spring being interposed between the first pin and an end of the slot to thereby bias the body member into locking engagement with the second pin.

6. The improved speed sensor of claim 1 including an external shutter member mounted for cooperation with the body member when the member is released and providing for movement of the shutter member thereby.

7. The improved sensor of claim 6 wherein said shutter member and sensor are incorporated in an air motor with the shutter member positioned adjacent a port for the motor, said shutter member being movable between a port open and port closed position upon engagement of the shutter member by the body member.

* * * * *